US006618987B1

(12) United States Patent
Bowker

(10) Patent No.: US 6,618,987 B1
(45) Date of Patent: Sep. 16, 2003

(54) REPAIRING OF DIVOTS

(76) Inventor: David Bourchier Bowker, 60 Fairway, Durban North, 4051 (ZA)

( * ) Notice: Subject to any disclaimer, the term of this patent is extended or adjusted under 35 U.S.C. 154(b) by 150 days.

(21) Appl. No.: 09/442,970

(22) Filed: Nov. 18, 1999

(30) Foreign Application Priority Data

Nov. 20, 1998 (ZA) ..... 98/10645

(51) Int. Cl.[7] ..... A01C 13/00

(52) U.S. Cl. ..... 47/1.01 R

(58) Field of Search ..... 47/1.01 R

(56) References Cited

PUBLICATIONS

Beard, Turf Management for Golf Couses, 1982, Burgess, p. 187–188, 225).*

* cited by examiner

*Primary Examiner*—Peter M. Poon

(57) ABSTRACT

A method of repairing a divot made by a golfer in the grass playing surface of a golf course provides for the golfer to deposit a divot repair body, comprising a growing material such as sand formed into a consolidated mass, into the divot. The body can then be crushed under foot for evenly spreading the growing material in the divot and thereby effectively filling the divot with the growing material. The invention relates also to a divot repair body that can be used in conjunction with the method and that can be carried by a golfer in a suitable package for rendering the employment of the method convenient.

18 Claims, 2 Drawing Sheets

REPAIRING OF DIVOTS

BACKGROUND OF THE INVENTION

This invention relates to the repair of divots.

The invention relates particularly to a method of repairing divots and to a divot repair body for use in this method.

The repair of divots, for example, in the playing surface of a golf course, made by golfers while playing the game of golf, is both labour intensive and time consuming. Golf course greens staff often use expensive and/or labour intensive methods such as scooping a growing material, usually sand, from buckets, bags and vehicles. By means of a spade or by hand, the sand is then deposited into and around divots formed in the playing surface. Certain golf clubs require golfers to carry sand bags with them and to fill divots made by them in the playing surface of their golf course. Such sand bags are both cumbersome and messy and the sand obtained from sand bins which are provided at such courses is often soggy and difficult to handle. Furthermore, research has shown that in spite of golfers carrying sand bags at golf clubs which require them to do so, the sand bags are often not filled for the reasons set out hereinabove.

SUMMARY OF THE INVENTION

Accordingly, it is an object of this invention to ameliorate many of the problems associated with the repairing of divots made by golfers in the playing surface of a golf course. It is a particular object of the invention to provide a method that can be implemented by golfers themselves for easily repairing divots made by them in the playing surface of a golf course, as well as to provide divot repair means for use in conjunction with this method.

Any reference hereinafter to the repair of a divot must be interpreted as a method of repairing a divot made by a golfer in the playing surface of a golf course.

According to the invention there is provided a method of repairing a divot which includes the steps of:

- providing a divot repair body which comprises a particulate growing material moulded into a consolidated mass;
- depositing the divot repair body into a divot to be repaired; and
- crushing the divot repair body and spreading the particulate growing material within the divot, to thereby fill the divot.

The method of the invention particularly may include, prior to depositing the divot repair body into the divot to be repaired, retrieving grass that was removed when the divot was formed and locating the grass in the divot.

The particulate material forming the divot repair body that is provided in conjunction with the method of the invention particularly is sand. The sand may be dyed green with a colouring agent.

Furthermore, a binding agent may bind the particulate growing material into its consolidated mass into which it is moulded, to form the divot repair body that is provided. The binding agent may be hydrous aluminium silicate.

The consolidated mass forming the divot repair body that is provided in accordance with the method of the invention may be moulded into any one of a plurality of different shapes and sizes, which are determined by at least one of the intended packaging mode of the body, the mode of handling of the body and the required quantity of growing material to be included in the body.

Still further in accordance with the method of the invention, the particulate growing material forming the divot repair body that is provided may include a nutrient with which it is moulded into the consolidated mass, which nutrient can serve to stimulate the growth of grass in a divot filled by the growing material.

The particulate growing material forming the divot repair body that is provided also may include a pH adjusting substance with which it is moulded into the consolidated mass, which pH adjusting substance serves to adjust the pH of the growing material to a level required by the grass with which the body is intended to be used.

Still further, the particulate growing material forming the divot repair body that is provided, in accordance with the method of the invention, may include grass seeds with which it is moulded into the consolidated mass.

The invention extends also to a divot repair body for use in a method of repairing a divot, which comprises a particulate growing material moulded into a consolidated mass that can be deposited into a divot in a grass covered surface and then be crushed to spread the growing material and thereby fill the divot.

The growing material typically is sand, although it may also be any alternative growing material such as sand. The sand may be dyed green with a colouring agent to render it less visible when filling a divot in a grass covered surface.

A binding agent may bind the growing material in its consolidated mass form into which it is moulded, a typical binding agent being hydrous aluminium silicate. Alternative binding agents also are considered suitable for the purpose.

The consolidated mass forming the divot repair body may be moulded into any one of a plurality of different shapes and sizes, which are determined by at least one of the intended packaging mode of the body, the mode of handling of the body and the required quantity of growing material to be included in the body.

Further according to the invention, the particulate growing material may include a nutrient with which it is moulded into the consolidated mass, which nutrient can serve to stimulate the growth of grass in a divot filled by the growing material.

Furthermore, the particulate growing material may include a pH adjusting substance with which it is moulded into the consolidated mass, which pH adjusting substance may serve to adjust the pH of the growing material to a level required by the grass for which the body is intended to be used.

The particulate growing material also may include grass seeds with which it is moulded into the consolidated mass. The grass seeds clearly can germinate, after the application of the divot repair body within a divot, to induce the growth of new grass in the location of the divot.

It is envisaged that a divot repair body or a set of divot repair bodies can be provided in a suitably packaged form, which will facilitate the use of a body by a golfer in accordance with the method of the invention as above defined. Various different forms of packages are envisaged that can be conveniently carried by golfers and from which a divot repair body can be conveniently deposited into a divot for filling the divot with the growing material.

Further features of a method of repairing a divot and of a divot repair body for use in the method, in accordance with the present invention, are described hereinafter by way of a non-limiting example of the invention, with reference to and as illustrated in the accompanying diagrammatic drawings. In the drawings:

DETAILED DESCRIPTION OF THE PREFERRED EMBODIMENT

Figure 1A:
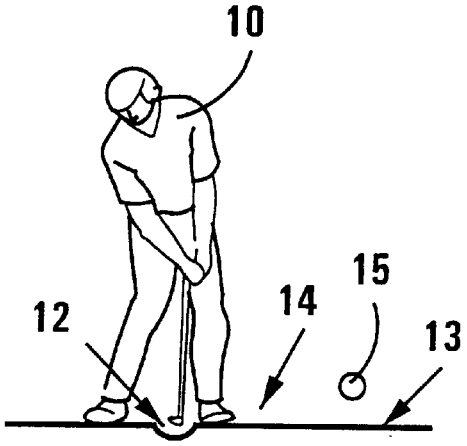
FIGS. 1A–F shows schematically a number of steps to be followed by a golfer in repairing a divot made by him in the playing surface of a golf course.

Referring initially to FIG. 1 of the drawings, a number of steps in the method of repairing a divot made by a golfer, in accordance with the invention, in the playing surface of a golf course, are illustrated. FIG. 1A illustrates a golfer 10 forming a divot 12 within a grass playing surface 13 of a golf course, the divot 12 being formed during the golf stroke which will cause a grass segment 14 to be removed from the grass playing surface 13 as a golf ball 15 is struck.

Figure 1B:
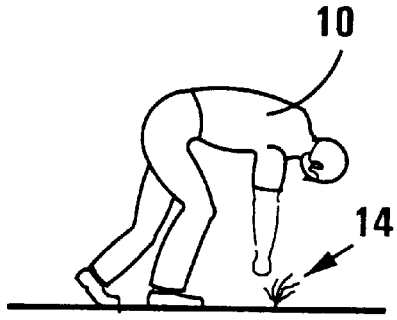
Figure 1C:
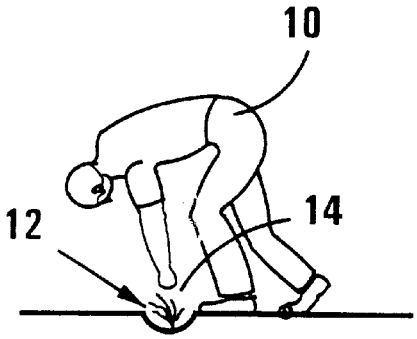
Figure 1D:
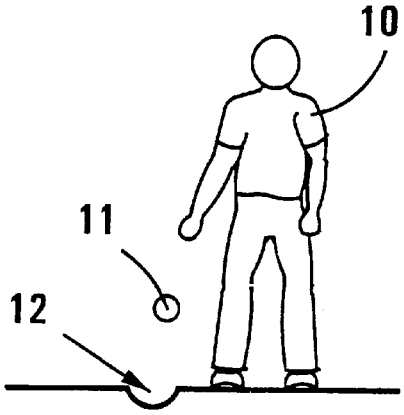

FIG. 1B illustrates a first step in repairing the divot 12, which involves retrieving the grass segment 14, if still in a consolidated form. The grass segment 14 is then replaced into the divot 12, as illustrated in FIG. 1C, following which a divot repair body 11 is deposited into the divot 12, as shown in FIG. 1D.

Figure 1E:
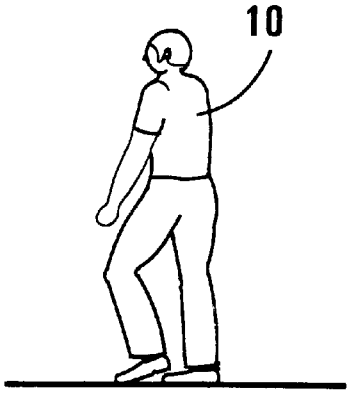
Figure 1F:
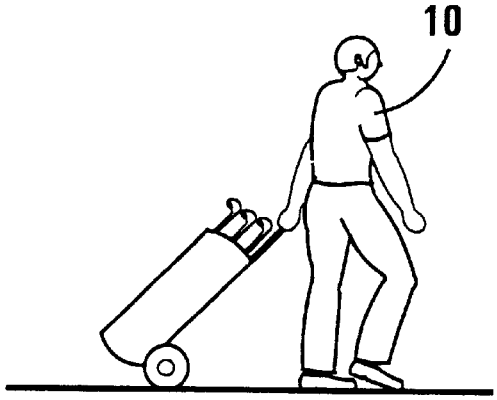

FIG. 1E illustrates the divot repair body 11 being crushed under foot by the golfer 10, using the sole of his shoe, simultaneously spreading the material forming the body 11 to effectively fill the divot 12. FIG. 1F illustrates the golfer 10 proceeding to his ball to play his next shot.

Figure 2:
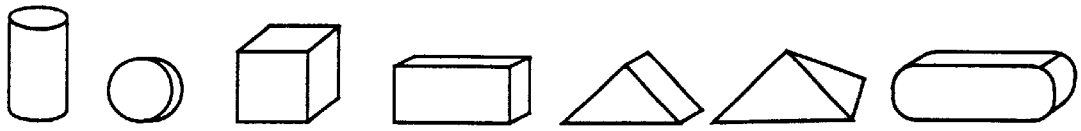
FIG. 2 shows a number of different forms of a divot repair body, in accordance with the invention.

The divot repair body 11 includes a quantity of moulded sand which is sufficient to fill a divot in the grass covered playing surface of a golf course to thereby facilitate the regrowth of grass therein. With reference to FIG. 2 of the drawings, a number of different shapes of moulded divot repair bodies are illustrated. It will be appreciated that the shape and size of the moulded divot repair body of the invention may vary greatly, while still incorporating the essential features of the invention. The divot repair body is provided in a pre-moulded form, thereby to facilitate ease of handling and to permit a predetermined moulded quantity of sand to be deposited into a divot, to repair it in accordance with the method above described.

The divot repair body includes a predetermined amount of nutrient for stimulating the growth of grass in the divot 12 having been repaired, whereas it is envisaged in this regard also that the divot repair body may include grass seed which will induce the growth of new grass within the region of a repaired divot. Still further, particularly where the sand to fill a divot to be repaired does not have a suitable pH level, the divot repair body also may include a suitable pH adjusting substance whereby the effective pH of the sand is adjusted to a desired level.

Divot repair bodies 11 as shown in FIG. 2 can be moulded into their required form by any suitable moulding process, it being envisaged in this regard that a suitable binding agent such as hydrous aluminium silicate can be used for retaining divot repair bodies formed in their required shape, particularly also when packaged prior to use.

Figure 3:
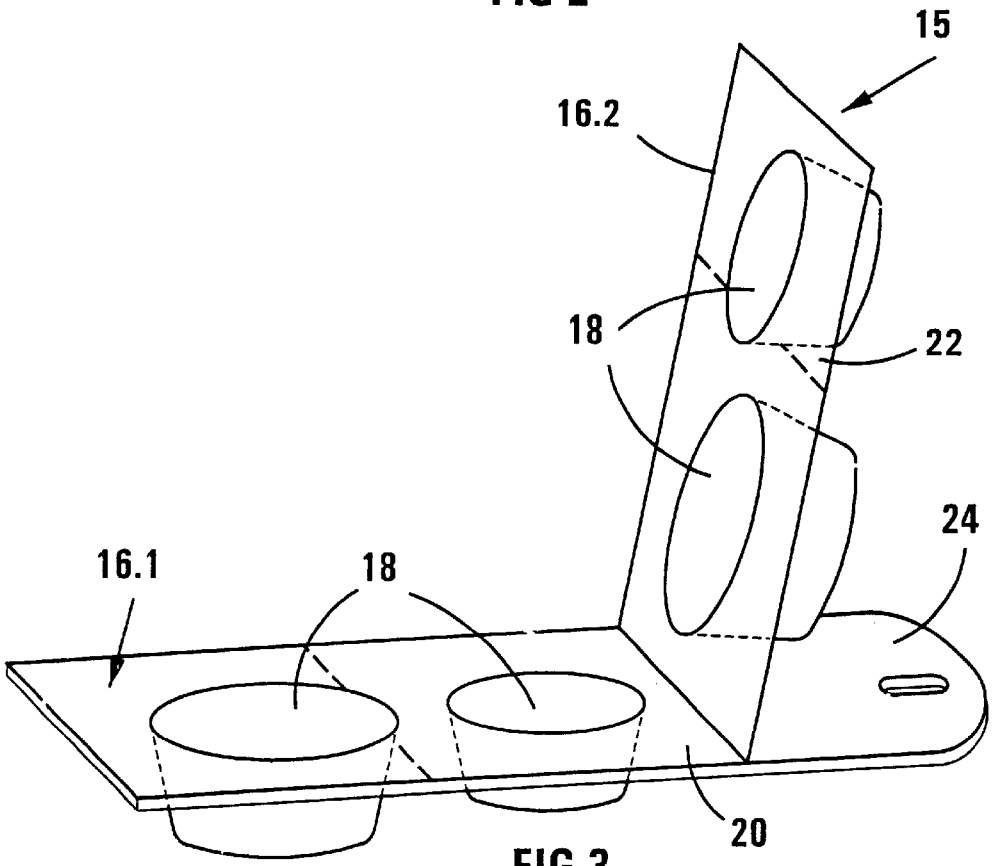
FIG. 3 shows a first embodiment of a package for carrying a plurality of divot repair bodies, in accordance with the invention.

FIG. 3 illustrates a particular type of package for containing a plurality of divot repair bodies 11, the package 15 having a pod-like structure that comprises two sheet-like package sections 16.1 and 16.2 that each define a pair of cup-like container formations. The package sections 16.1 and 16.2 are foldable with respect to one another with respect to a fold line 20 between an open condition as shown in FIG. 3 of the drawings, and a closed condition wherein the container formations of the package 16.1 and 16.2 form two halves of a pair of container formations that together define compartments in which bodies 11 can be contained. The package sections 16.1 and 16.2 are releasably attached to one another by means of a suitable adhesive, thereby to permit the package sections to be peeled apart to open a particular compartment for releasing the body 11 contained therein. The package section 16.2 further includes a further fold line 22 which separates the container formations 18 of the package section 16.2, from one another, thereby permitting the container formations to be separately peeled apart from their counter parts in the package section 16.1 for separately releasing bodies 11 therefrom. The package 15 includes a lug 24 by which the package can be hung, for example, from a hook or the like, on a golf bag.

Figure 4:
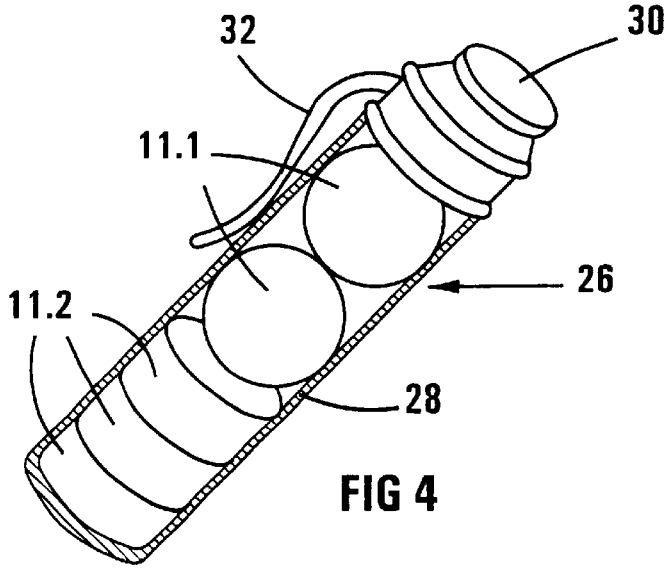
FIG. 4 shows a second embodiment of a package for carrying a plurality of divot repair bodies, in accordance with the invention.

FIG. 4 illustrates another embodiment package for containing a plurality of divot repair bodies 11. The package, generally designated by the numeral. 26, is in the form of a cylindrical container body 28 which has a removable lid 30. The lid 30 has a lug formation 32 projecting therefrom which can serve to hang the package 26 from a golf bag, a golf cart, or the like. As is illustrated in FIG. 4 of the drawings, the package 26 can contain spherical divot repair bodies 11.1 or tablet-type divot repair bodies 11.2, it being envisaged in this regard that alternative form packages can be provided for carrying alternative form divot repair bodies, particularly forms as illustrated in FIG. 2 of the drawings.

The Applicant believes that the general maintenance of the grass playing surface of a golf course can be significantly facilitated by golfers carrying and using divot repair bodies, in accordance with the invention, for repairing divots made by them, particularly by carrying out the method of the invention as hereinabove described. The use of divot repair bodies as envisaged, in practice, can provide an inexpensive and simple-to-use means for repairing divots, which can reduce the expensive and labour intensive methods that are currently used by golf course green staff, which can only be carried out "after hours" when golfers are not present on a golf course.

What is claimed is:

1. A method of repairing a divot which includes the steps of:

providing a divot repair body which comprises a particulate growing material pre-selected to accommodate turf requirements of a golf course, said body being moulded into a dry, consolidated mass of a pre-measured amount;

depositing the divot repair body into a divot to be repaired; and crushing the divot repair body and spreading the particulate growing material within the divot, to thereby fill the divot.

2. A method as claimed in claim 1, which includes, prior to depositing the divot repair body into the divot to be repaired, retrieving grass that was removed when the divot was formed and locating the grass in the divot.

3. A method as claimed in claim 1, in which the particulate material forming the divot repair body that is provided is sand.

4. A method as claimed in claim 3, in which the sand is dyed green with a colouring agent.

5. A method as claimed in claim 1, in which a binding agent binds the particulate growing material into its consolidated mass into which it is moulded to form the divot repair body that is provided.

6. A method as claimed in claim 5, in which the binding agent is hydrous aluminium silicate.

7. A method as claimed in claim 1, in which the particulate growing material forming the divot repair body that is provided includes a nutrient with which it is moulded into the consolidated mass, which nutrient can serve to stimulate the growth of grass in a divot filled by the growing material.

8. A method as claimed in claim 1, in which the particulate growing material forming the divot repair body that is provided includes a pH adjusting substance with which it is moulded into the consolidated mass, which pH adjusting substance serves to adjust the pH of the growing material to a level required by the grass with which the body is intended to be used.

9. A method as claimed in claim 1, in which the particulate growing material forming the divot repair body that is provided includes grass seeds with which it is moulded into the consolidated mass.

10. A method as claimed in claim 1 further comprising, before the step of providing a divot repair body, steps of:

moulding a plurality of divot repair bodies; and storing said plurality of divot repair bodies in a portable package.

11. A divot repair body for use in a method of repairing a divot, which comprises a particulate growing material pre-selected to accommodate turf requirements of a golf course, said body being moulded into a dry, consolidated mass of a pre-measured amount that can be deposited into a divot in a grass covered surface and then be crushed to spread the growing material and thereby fill the divot.

12. A divot repair body as claimed in claim 11, in which the growing material is sand.

13. A divot repair body as claimed in claim 12, in which the sand is dyed green with a colouring agent.

14. A divot repair body as claimed in claim 11, in which a binding agent binds the growing material in its consolidated mass form into which it is moulded.

15. A divot repair body as claimed in claim 14, in which the binding agent is hydrous aluminium silicate.

16. A divot repair body as claimed in claim 11, in which the particulate growing material includes a nutrient with which it is moulded into the consolidated mass, which nutrient can serve to stimulate the growth of grass in a divot filled by the growing material.

17. A divot repair body as claimed in claim 11, in which the particulate growing material includes a pH adjusting substance with which it is moulded into the consolidated mass, which pH adjusting substance serves to adjust the pH of the growing material to a level required by the grass for which the body is intended to be used.

18. A divot repair body as claimed in claim 11, in which the particulate growing material includes grass seeds with which it is moulded into the consolidated mass.

* * * * *